US008215401B2

(12) United States Patent
Braekke et al.

(10) Patent No.: US 8,215,401 B2
(45) Date of Patent: Jul. 10, 2012

(54) EXPANDABLE BALL SEAT

(75) Inventors: Kristoffer Braekke, Stavanger (NO); Geir Lunde, Sandnes (NO); Roger Antonsen, Randaberg (NO)

(73) Assignee: I-Tec AS, Royneberg (NO)

( * ) Notice: Subject to any disclaimer, the term of this patent is extended or adjusted under 35 U.S.C. 154(b) by 78 days.

(21) Appl. No.: 12/705,428

(22) Filed: Feb. 12, 2010

(65) Prior Publication Data

US 2011/0198100 A1 Aug. 18, 2011

(51) Int. Cl.
*E21B 43/00* (2006.01)

(52) U.S. Cl. ..... 166/318; 166/332.4

(58) Field of Classification Search ..... 166/332.3, 166/318, 316, 325, 332.4, 386
See application file for complete search history.

(56) References Cited

U.S. PATENT DOCUMENTS 4,360,063 A * 11/1982 Kilgore ..... 166/317
7,322,417 B2 1/2008 Rytlewski et al.
2002/0050361 A1* 5/2002 Shaw et al. ..... 166/380
2006/0243455 A1 11/2006 Telfer et al.
2009/0308588 A1 12/2009 Howell et al.

OTHER PUBLICATIONS

Norwegian Search Report for Norwegian Patent Application No. 20100211 dated Sep. 1, 2010.

* cited by examiner

*Primary Examiner* — Kenneth L Thompson
*Assistant Examiner* — Yong-Suk Ro
(74) *Attorney, Agent, or Firm* — Marshall, Gerstein & Borun LLP

(57) ABSTRACT

Apparatus for a drop ball activated device, where a ball seat is concentrically and axially slidably disposed within an outer sleeve having a first internal cylindrical surface, wherein the ball seat comprises at least one radially extending lug, which in a first position extends radially inwards from the internal cylindrical surface, thereby defining a first ball seat diameter less than the diameter of the drop ball. The sleeve comprises at least one groove in its internal surface, and the lug may be received in the groove, thereby defining a second ball seat diameter at least as large as the diameter of the drop ball.

10 Claims, 6 Drawing Sheets

EXPANDABLE BALL SEAT

BACKGROUND OF THE INVENTION

1. Field of the Invention

The present invention relates to an expandable ball seat for use in subterranean wells, in particular for wells used for production of hydrocarbons from subterranean formations.

2. Prior Art

To produce hydrocarbons, i.e. oil and/or gas, from subterranean reservoirs, a well extending through several strata of rock in a formation is provided. The well is usually constructed by drilling a borehole a distance through the rock, insert a steel casing into the wellbore and cement it to the formation. Cementing usually involves pumping wet cement down through a tubular liner and casing, out through a floating or sliding sleeve valve and up through the annulus formed by the formation and casing before the cement is left to set. The next section is drilled through the formation in the extension of the existing casing. A liner is then hung off by a liner hanger, and cemented to the formation. This process is repeated until a well comprising a number of sections with ever decreasing diameters have reached the desired depth. Typically one or more strata of the formation contain hydrocarbons, and typically the productive strata are separated by rock that does not carry oil or gas. To access the formation fluids, the casing may be penetrated at depths corresponding to the productive strata, and the formation may be hydraulically fractured to facilitate the flow of fluid from the formation into the production well. Horizontal wells may also branch out from a vertical production well, and extend several kilometers through a layer containing hydrocarbons.

A production pipe is typically provided within the casing or liner, and the completed well can be divided into several production zones by using packers. Valves control the flow of fluid during cementing. Other valves control fluid flow into a segment of production pipe corresponding to the production zone. In operation, fluid flowing from several zones at different rates can be mixed and conveyed up the production pipe to the surface.

To increase the amount and/or rate at which hydrocarbons are produced from a zone, various chemicals may be injected into the formation. The chemical may be water, brine, acids, solvents, surfactants etc, and it can be injected through the production well, or through one or more injection wells that may be provided at a distance from the production well. Thus, a typical oil or gas field can comprise one or more production wells, and zero or more injection wells. In some cases, an injection well may for example inject water or gas into or more zones to increase the pressure in the reservoir. Various additives to decrease the viscosity of fluid in a particular zone may also be injected. Such methods are collectively known as "stimulating a zone", and their purpose is to enhance production from the zone. Particular methods for stimulating a zone are not part of the present invention, and hence not described in further detail in this disclosure. However, it should be understood that providing a larger number of injection points in a zone would help in distributing fluids and/or chemical additives in the zone.

It would also help production if the production well could be divided in more zones in a convenient and economical manner. For example, if water is injected through an injection well and breaks through the formation at some point along a horizontal branch of a well, the water content in the produced fluid could quickly exceed a predetermined level, and cause a decision to shut down that particular branch. However, there may be significant pockets of oil and gas left in the formation outside the region of water breakthrough. Hence, valves and packers may be provided to be able to isolate a certain section or zone in the horizontal well at a later time should this situation occur. On the other hand, the cost of valves and the time required to open a large number of valves when the zone is to be put into production can limit the number of sections or zones per branch. In turn, this might result in relatively large "dead zones" containing hydrocarbons that cannot be retrieved.

As indicated above, various mechanical devices are used during construction, completion and production, e.g. liner hangers, packers and valves of different sizes and designs. One of several ways to operate a mechanical device in a well is by using a drop ball, which are dropped or pumped with a fluid down into the well until it lands on a ball seat. Then, hydraulic pressure acts on the equipment and causes a relative movement between two parts, which movement activates the device. Devices activated by drop balls or other similar objects are comparatively inexpensive, and they do not require costly interrupts in the production, such as those caused when a working string or running tool must be run into the well.

The terms "drop ball" and "ball seat" are used for convenience herein, as drop balls are the most common means for activating devices in the well hydraulically. However, it should be understood that other equivalent objects used for the same purpose are considered as well. For example, a dart plug may be inserted in the fluid flow just ahead of the cement when a liner is to be cemented to the formation during completion of the well. The dart plug has a cylindrical body to separate the cement from the fluid below, and it typically has a rounded conical nose similar to a drop ball. When the dart lands on a seat connected to the valve, the fluid circulating through the liner is shut off, and hydraulic pressure builds up behind the dart. When the pressure reaches a predetermined level, shear pins or the like, which originally prevented relative movement between inner and outer sleeves of the valve, breaks. Then the sliding sleeve of the cementing valve slides downstream and opens the cementing valve, allowing cement to enter the annulus between the liner and the formation. After use, the dart may conventionally be broken, e.g. by a drill bit when the next section of the well is constructed. In a similar manner, a drop ball might have been used for the same purpose. Thus, the dart has the same function as a drop ball in that it lands on a seat, thereby closing fluid circulation such that hydraulic pressure can operate on a device.

A series of drop ball might be used to operate valves and other devices at different times and locations. For example, a series of drop balls may be used to operate a series of valves in different zones in order to open or shut off production from different zones in a production phase of a well. Conventionally, this is done by decreasing the diameters of the ball seats with increasing depth and using balls of different sizes. Then, a drop ball having a certain diameter will pass all the seats with larger diameters and land on the first seat having a diameter less than the diameter of the ball. Once the ball shuts off circulation, hydraulic pressure builds up behind it, and can be used to activate the device, e.g. by breaking a shear pin and/or provide some relative movement between parts within the device.

However, there is a limit to the number of different ball sizes that can be used in a well. If, for example, the diameters of two balls are too close to each other, even a minor piece of debris, sand or grit might cause a ball to land on a seat with a diameter slightly larger than the intended seat, thereby unintentionally activating the wrong device. Hence, there must be a minimum diameter difference between the drop balls to be used in a certain application. This also limits the number of pieces of equipment that can be operated by conventional drop balls or seats in a given well. Typically, about 20 or less ball seats may be used in one well for the reason discussed above.

As modern reservoirs increase in size and/or in depth, using drop balls in the conventional manner becomes impractical. For example, a well may extend 2000 meters or more vertically and/or horizontally. Using a maximum of 20 drop balls of different sizes, the mean distance between drop ball activated devices becomes 100 meters or more. This may exceed the thickness of a production zone. Because at least one valve should control the flow of fluid from each production zone, less than 20 ball operated valves will be available for use in horizontal wells branching out into the production zone(s).

In some cases it would be advantageous or necessary to provide more than one valve controlling the flow of formation fluid into the production pipe, limiting the number of ball activated valves available for other zones and/or horizontal wells even further. Using equipment operated by other means quickly becomes costly, as electrical motors need to handle the temperatures and pressures in deep wells, hydraulic lines become longer etc. Hence, it would be advantageous to provide a system wherein one drop ball could open an arbitrary number of valves in a vertical or horizontal well.

If there was a way to open an arbitrary number of valves by one drop ball in e.g. one production zone and/or horizontal branch, a large number of inexpensive valves could be installed. This would help when stimulating a zone in that fluid could be injected through a large number of injection points, and to drain the formation fluid into a production pipe through an arbitrary number of valves.

Thus, a main objective of the present invention is to provide an apparatus capable of activating an arbitrary number of drop ball operated devices using one drop ball only.

In particular, it would be feasible to install a greater number of valves to increase the number of injection points in an injection well. It would also be feasible to increase the number of valves in a long horizontal well, because all of them could be opened fast with one drop ball only. If, for example, water breaks through at a later time, a relatively small zone could be shut off, limiting the "dead zone" or pocket of hydro carbons that cannot be retrieved from the formation. Such a shutdown of certain valves could be done using methods known in the art, e.g. by providing the valves with standard fittings for conventional tools, and run a tool into the well by coiled tubing, slickline, a well tractor or running tool etc.

SUMMARY

The main objective is achieved by providing an apparatus operated by a drop ball wherein a drop ball seat is concentrically and axially slidably disposed in an outer sleeve comprising a first, internal cylinder face, wherein the seat comprises at least one outwardly biased lug, which, when abutting the first, internal cylinder face extends radially inwards and defines a first seat diameter less than the diameter of the drop ball; the sleeve comprising at least one groove in its internal surface; and the lug, when received in the groove, defining a second seat diameter being at least as large as the diameter of the drop ball.

As the seat diameter increases to the second seat diameter, the drop ball (or dart or similar object) will pass through and proceed to the next ball operated device, where the process is repeated. Thus, one ball may be used to operate an arbitrary number of devices having similar seat diameters, e.g. all valves or devices of a certain type in a zone. Still, differently sized balls may conveniently be provided as in prior art. With the present invention one ball might be used to open an arbitrary number of valves in a production zone, whereas the next larger ball might be used to operate any number of devices in the production zone above. Thus, any desired number of drop ball operated valves or other devices can be installed in a production zone, greatly reducing the number of expensive valves operated by other means and/or improve the production from a zone.

In another aspect, the present invention provides a method using the apparatus.

In yet another aspect, the present invention comprises a method for activating and deactivating an arbitrary number of drop ball operated devices in a well using a single drop ball.

BRIEF DESCRIPTION OF THE DRAWINGS

The invention will be fully explained in the following detailed description with reference to the accompanying drawings in which similar numbers references similar or equivalent parts, and in which.

DETAILED DESCRIPTION

Figure 1:
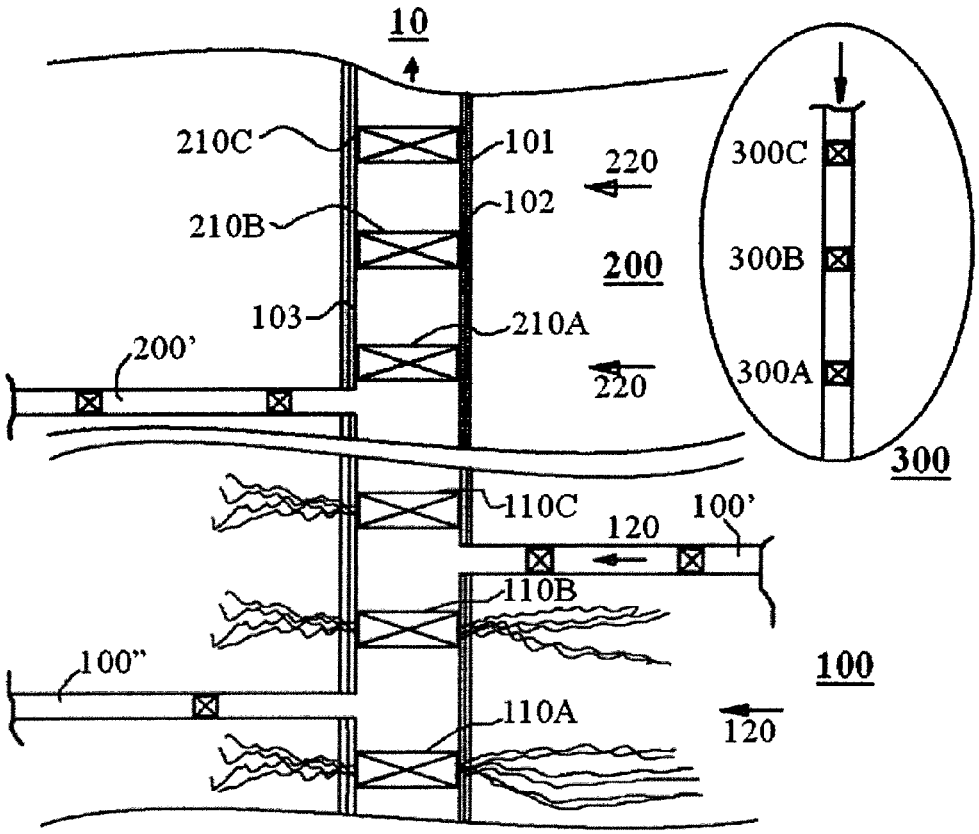
FIG. 1 is a schematic view of a well comprising several zones and branches.

FIG. 1 is a schematic cross sectional view of a well system used in production of hydrocarbons, i.e. oil and/or gas, from a subterranean reservoir. A hole or wellbore 101 is drilled through several strata of rock in the formation. In FIG. 1, two strata or layers 100 and 200 are shown. The wellbore is lined with a steel casing 102, which is cemented to the formation. In FIG. 1, the layers 100 and 200 contain hydrocarbons, and may be separated by rock layers that do not contain oil or gas. The casing 102 may be penetrated at depths corresponding to the productive strata 100 and 200, and hydraulic fracturing may be used to create and open cracks in the formation to facilitate fluid flow from the formation into the production well. Horizontal wells 100', 100" and 200' may also branch out from a vertical production well, and extend several kilometers through a layer 100, 200 containing hydrocarbons.

A production pipe 103 is typically provided within the casing or liner 102, and the completed well can be divided into several production zones by using packers (not shown). The valves 110A-C, 210A-C, in FIG. 1 control fluid flow from a formation 100, 200 into the segment of production pipe corresponding to the production zone. The valves will generally be of different design or types, e.g. sliding sleeve valves, butterfly valves and ball valves of different sizes and designs used for different purposes as known in the art. In operation, fluid flowing from several zones (shown by arrows 120) at different rates can be mixed and conveyed up the production pipe to the surface 10.

In order to increase the amount and/or rate at which hydrocarbons are produced from a zone, one or more injection wells 300 may be provided at a distance from the production well. An injection well insert fluid into one or more zones, e.g. to increase the pressure in the reservoir or to provide some chemical composition, and can be made in a similar manner as the production well. A typical oil or gas field can comprise one or more production wells and zero or more injection wells.

As discussed above, various devices like sliding sleeve valves, butterfly valves and ball valves of different sizes and designs, can be used to control fluid flow and for other purposes. For convenience, the term "ball operated device" is intended to include these and other devices when hydraulically operated using a drop ball, dart or similar device. All such ball operated devices comprises a seat on which the ball, dart or similar device can land.

Figure 2:
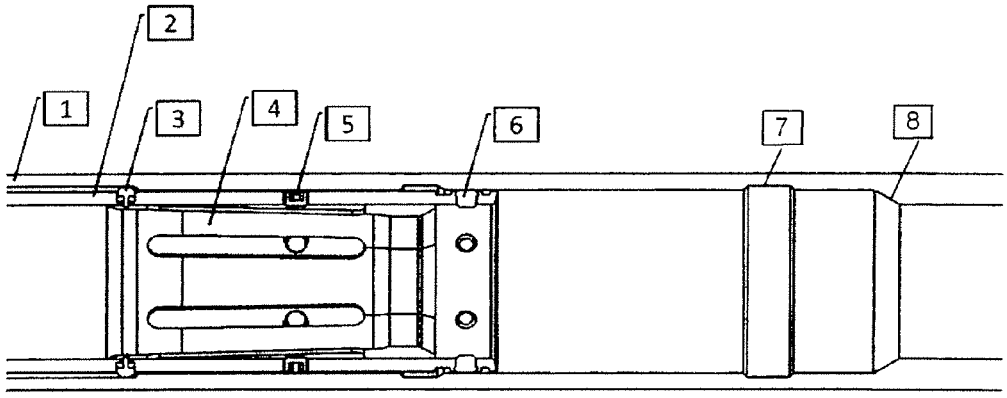
FIGS. 2-5 show a drop ball activated valve using the invention in several stages during activation.

FIG. 2 shows a sliding sleeve valve using a preferred embodiment 4 of the ball seat according to the present invention. A sliding sleeve valve is open when holes in the sleeves 1 and 2 are aligned, and closed when the holes are not aligned. Hence, the valve may be operated by a simple axial displacement, and is well suited for illustrative purposes. However, it should be understood that the invention can be used with any ball operated device. The device on FIG. 2 comprises an outer sleeve 1 having an internal surface having two parts: an internal cylindrical surface and an annular groove 7 with a slightly larger diameter adapted to receive one or more lugs 6 as described below.

A sliding sleeve 2 is disposed concentrically within the outer sleeve 1. The sliding sleeve 2 is able to slide axially along the inner face of sleeve 1, and is attached to a cage 4 implementing the ball seat as described in connection with FIG. 10 below. In FIG. 2, the ball seat cage 4 is retained in the outer sleeve 1 by shear pins 3, which keep this particular valve in a natural closed position during installation of the valve in a well, and are designed to break when a predetermined force is applied to them.

Figure 3:
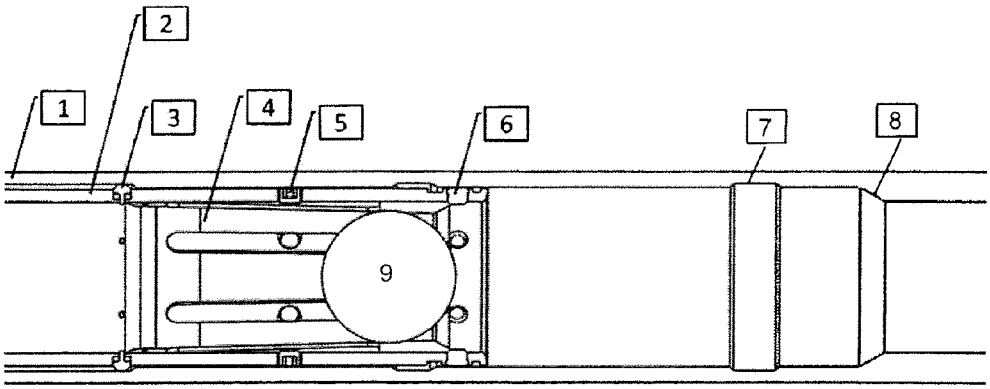

FIG. 3 shows the device of FIG. 2 where a drop ball 9 has landed on the seat. The seat is provided by flexible fingers on the cage 4 that are pressed radially inwardly by lugs 6 when the lugs abut the inner cylindrical surface of the outer sleeve 1. When the drop ball has landed on the seat as shown in FIG. 3, hydraulic pressure builds up behind it and exerts a force on a working area. When this force is sufficient to activate a first release mechanism, the ball and seat proceed to the position shown in FIG. 4. This first release mechanism is illustrated by heads of the pins 3 skipping past a small shoulder on the interior face of the outer sleeve 1. However, it should be understood that shear pins could provide the first release mechanism in another embodiment.

Figure 4:
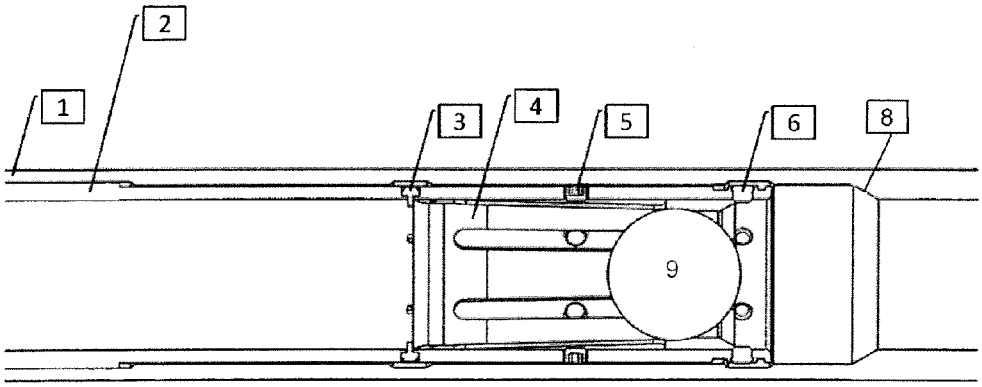

In FIG. 4, the cage 4 with the ball 9 has pulled the inner sleeve 2 along the outer sleeve 1, but shear pins 3 are still intact. Lugs 6 are at the axial position of an annular groove 7 with extended diameter. In another embodiment, the lugs 6 might at this point snap or outwards and into the groove 7, thereby releasing the ball 9. However, in the present embodiment the lugs 6 are still prevented from extending into the groove 7. This may be done in a number of ways, e.g. by providing the stoppers 5 with heads to prevent the fingers from extending into the groove until the stoppers reach the position shown in FIG. 5, or by providing a breakable band around the distal ends of the fingers 41 shown on FIG. 10. Thus, the ball seat still has its smaller diameter. This allows a further build up of hydraulic pressure until the force working on the ball and seat is sufficient to activate a second release mechanism, which may be convenient to ensure a predetermined minimum force required to ensure that the device is properly operated. This second release mechanism is illustrated in the figures as shear pins 3. In other embodiments, the second release mechanism could be a breakable band, lugs or other release mechanisms known in the art. Thus, in the present exemplary embodiment, the shear pins 3 could be designed to break at a force that is guaranteed to pull the sliding sleeve valve entirely open.

Figure 5:
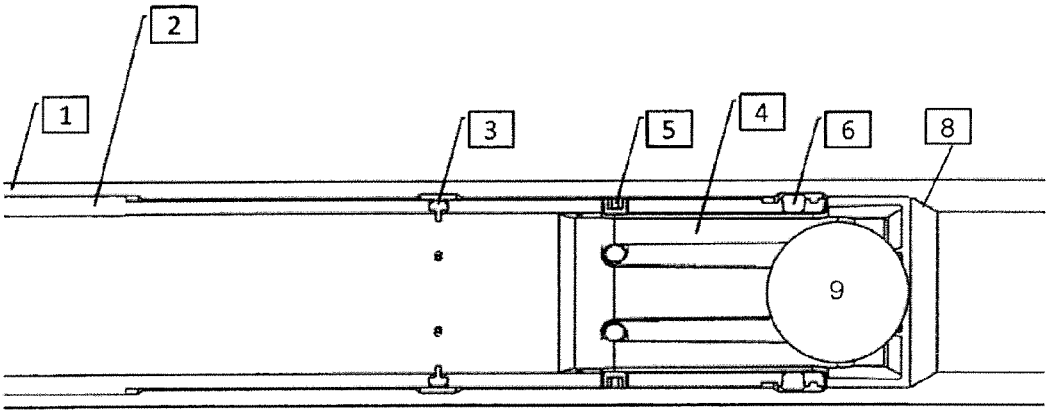

In FIG. 5, the cage 4 has been released from the inner sleeve by a second release mechanism, e.g. by broken shear pins 3. The seat 4 has moved further downstream until it has been stopped by the stoppers 5, which at this point have engaged the end of cage 4, or more particularly the ring 40 on FIG. 10. In an alternative embodiment, the cage may be prevented from moving downstream by a shoulder 8. Now, the lugs 6 may be pressed radially outwards into the groove 7.

Figure 6:
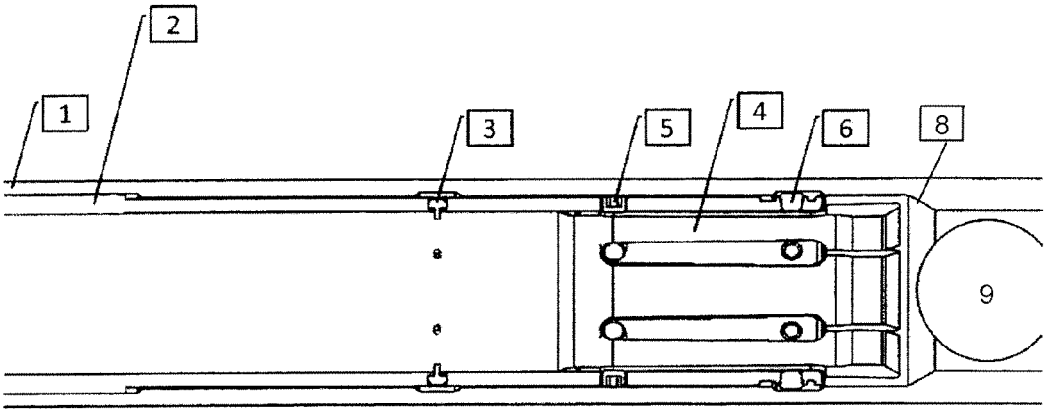
FIG. 6 shows the device on FIGS. 2-5 in the final stage, wherein the drop ball is released.

In FIG. 6, the lugs 6 are pressed radially outwards into the groove 7 provided on the inner surface of the outer sleeve 1. This expands the ball seat to a diameter where it no longer retains the ball 9. This is illustrated by the ball 9 in a position downstream, i.e. to the right in the figures, of the cage 4. The ball 9 may proceed to the next apparatus, which of course can have the same diameter on the seat as the one previously disclosed.

By providing a series of valves or other devices with a ball seat according to the invention, one ball may in this way be used to operate an arbitrary number of devices.

It should be understood that the embodiment of a sliding sleeve valve is an example only. Another application of the ball seat according to the invention could be within a butterfly valve or ball valve, in which a rotary movement rather than the linear movement disclosed previously, is used to activate the device. In order to translate the inherently linear movement of the drop ball to a rotation, a pair of helical shoulders could be provided on the inner and outer sleeves. When the seat is released by the first release mechanism, the seat 4 moves until the helical shoulders (not shown) engage each other. Then, hydraulic pressure behind the drop ball may be allowed to build up sufficiently to guarantee a relative rotation between the sleeves. This rotation may be used to rotate a circular plate in a butterfly valve or a ball in a ball valve. The second release mechanism, illustrated above as a broken shear pin, could equally well be radially biased dogs or some other means known in the art. The purpose of the release mechanisms are simply to ensure that sufficient force is available to operate the device properly before the next step in operating a device or before the drop ball is released further downstream.

Figure 7:
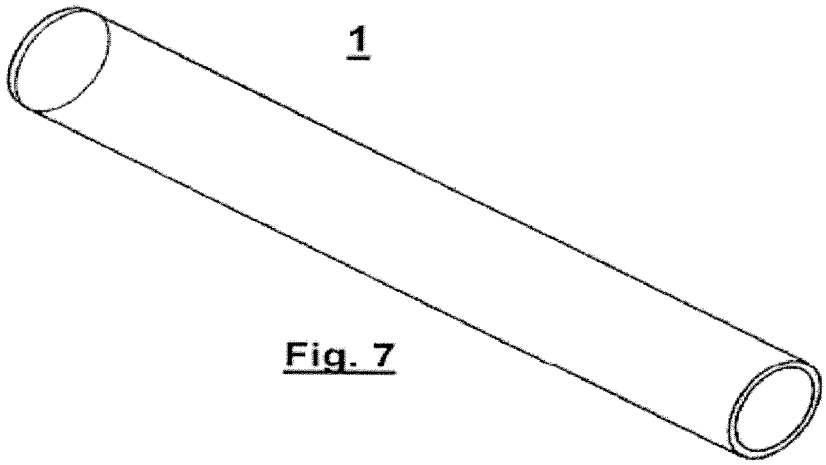
FIGS. 7-12 show various details of the device.

FIG. 7 shows a generalized outer sleeve 1. No holes are shown in the sleeve in order to illustrate that the ball seat of the invention may be used in any ball operated device, not only in a sliding sleeve valve. The outer sleeve 1 may comprise standard threading in both ends for inclusion into a tubular string, such as a production pipe, a liner or a casing, before it is inserted into a wellbore as part of the tubular string. The features of importance for the present invention is its internal surface comprising one or more grooves 7 to receive lugs 6 as discussed with reference to FIGS. 2-6.

Figure 8:
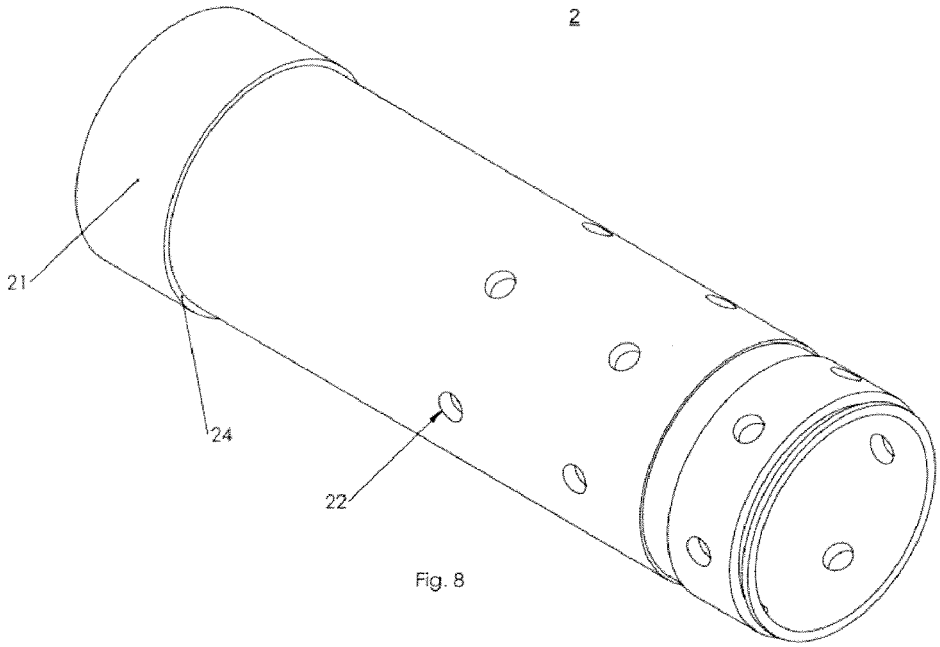

FIG. 8 shows an inner sleeve for a sliding valve, such as the one discussed above. The sleeve has a cylindrical main portion with radially extending ports 22. One end has an end part 21 with extended radius. The shoulder 24 formed between the main cylinder and the end part 21 stops the sleeve 2 from moving downstream as it engages a corresponding shoulder on the inner face of the outer sleeve. This may be used to activate the first release mechanism described above if relative axial movement between the cage 4 and the sleeve 2 is allowed.

Figure 9:
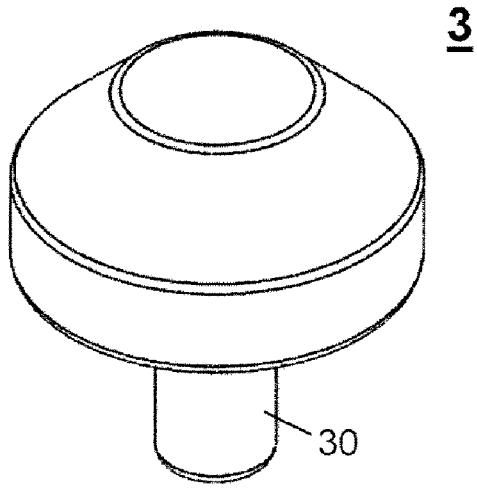

FIG. 9 shows an embodiment of a pin 3 used to illustrate the first and second release mechanisms in the description referring to FIGS. 2-6. The tapered head of pin 3 is intended to illustrate the first release mechanism. In one embodiment, the pin shown in FIG. 9 is biased radially outwards. When the tapered face of the head engages a shoulder on the interior surface of the outer sleeve, the pin 3 will be pressed radially inwards against a force, e.g. a spring force. The tapered face and the bias can be adjusted to provide a first release mechanism releasing cage 4 when a first force or pressure is achieved. Obviously, similar release mechanisms in the form of spring biased dogs or similar devices may be used to implement a release mechanism. It should also be understood that while a shear pin 3 provides a second release mechanism in the examples above, some embodiments may have no second release mechanism. Other embodiments may have a different second release mechanism, e.g. a biased pin or lug.

Figure 10:
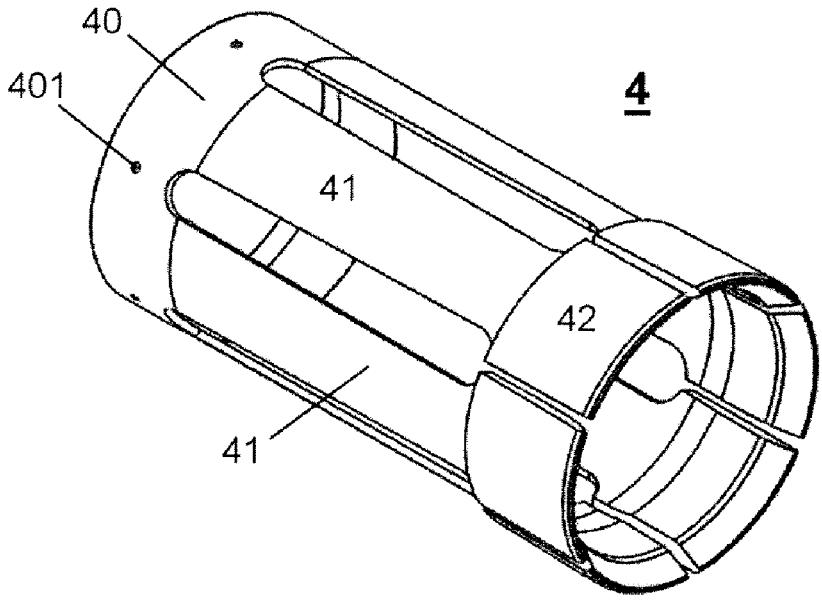

FIG. 10 shows cage 4 formed by a number of fingers 41 parallel to each other, and attached to a ring 40 at one end. The ring 40 is upstream when the cage is in use, and the ball seat is provided inside the cage opposite ring 40. The fingers can be inflexible, e.g. formed of a material that undergoes a plastic deformation when the fingers are bent inwards. In this case the force required to bend them back may provide part or all of the resistance required to prevent the lugs 6 from entering the groove 7 in FIG. 4, when the cage 4 is not yet retained by stoppers 5 or shoulder 8. Alternatively, the fingers may be flexible and provide a force directed radially outwards when pressed in by lugs 6. In this case, the situation in FIG. 5 would be extremely short, as flexible fingers immediately would snap outwards, moving the lugs 6 into groove 7. Yet another alternative is to attach the fingers 41 to the ring 40 by hinges, and provide the fingers with spring bias, retaining rings etc as required by the application.

There is a space between the fingers 41, such that the ends opposite the ring 40 may be pressed radially inwards to form a ball seat inside the cage 4 as described above. Radially extending lugs (not shown in FIG. 10), such as the lugs 6 described above, is a convenient way of pressing the fingers radially inwards. The distal or downstream ends of the fingers 41 may be pressed together to form a continuous ring 42, the ball seat being defined by the inner diameter of ring 42. A breakable band may be provided around the ring 42 in order to prevent the lugs 6 from snapping into groove 7 until a certain minimum force is available.

In FIG. 10, the space between the sections of ring 42 is shown as quite narrow for illustrative purposes. However, it should be understood that the space between the sections of ring 42 may be wider, such that the inner diameter of the continuous ring 42 forms a ball seat with a minimum diameter. In this case one type of cage 4 can be used for several ball diameters between this minimum diameter and the diameter of the ring 40 simply by providing lugs 6 of different lengths.

The cage 4 is typically retained within an outer housing until released by a release mechanism. The holes 401 in ring 40 are adapted to the lower part 30 of the pin 3 shown in FIG. 9, thus indicating that the cage 4 is released from the sleeve 2 by the second release mechanism of the embodiment described above. Of course, shear pins are just one convenient release mechanism, and the cage 4 can be provided with other elements than the holes 401 to fit another release mechanism if desired.

Figure 11:
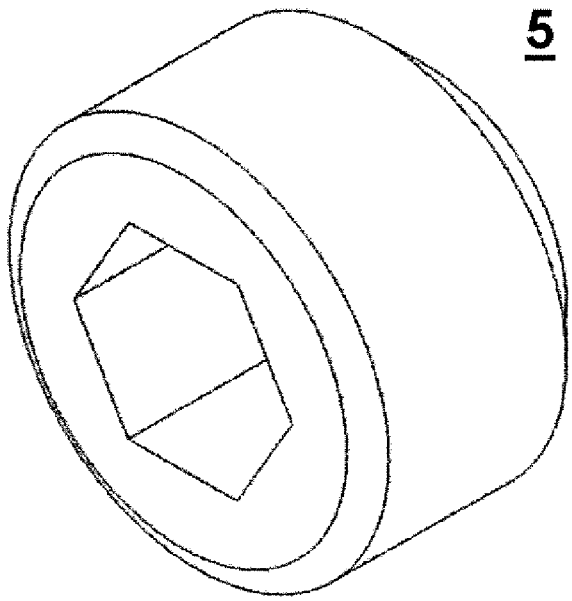

FIG. 11 illustrates a cylindrical stopper 5 having an outer diameter slightly less than the space shown between the fingers and rings 40 and 42 in FIG. 10. The main function of the stoppers 5 is to prevent the cage 4 from travelling downstream when the valve is open. Alternatively, a shoulder 8 may be provided for the same purpose.

Figure 12:
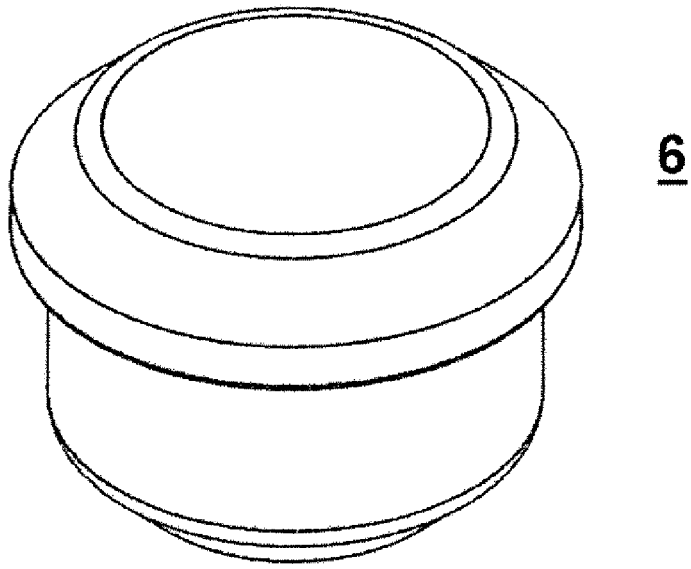

FIG. 12 shows a lug 6, which in the preferred embodiment is used to press a finger 41 radially inwards when disposed between e.g. the outer circumference of ring 42 and the inner surface of the sleeve 1, thus preventing the finger 41 from moving outwards until the lug 6 reaches the groove 7. Lugs 6 of different lengths may be used to provide ball seats of different diameters.

In another aspect, the invention comprises a method for activating an arbitrary number of drop ball operated devices in a well, comprising the steps of:

- inserting a drop ball into a tubular string comprising at least one apparatus able to be activated and to release the ball after activation,
- monitoring and controlling the pressure, and
- determine when the drop ball has activated and been released from the arbitrary number of devices.

A suitable apparatus for this method is the one described previously, in which hydraulic pressure is the only means necessary to operate an arbitrary number of devices. The pressure, or an equivalent like the load of a circulating pump, may be monitored to determine the point in time when the drop ball (9) arrives at a ball seat, at which time an increased pressure may be detected. If desired, pump pressure may be added to the hydraulic pressure exerted by the column of fluid behind the drop ball in order to operate one or more release mechanisms for the device as described more fully above. Similarly, a drop in pressure or pump load can indicate that the drop ball has left the device, and no longer inhibits fluid flow in the string. These steps may be repeated until all devices are operated.

Referring back to the introductory part of the present disclosure, it would be advantageous to subdivide a well into several zones, each zone having several devices. Using the apparatus disclosed previously, it can readily be seen that several groups of devices may be provided, each group being operated by one drop ball, and each group may be operated by a drop ball of different size than the drop ball for the other groups. By installing a group of devices operable by the smallest sized drop ball furthest away from the surface in a vertical or horizontal branch, this group of devices would be the first to be activated. This matches a normal production scenario, in which, for example, a waterfront from an injection well is expected to reach the most far away parts of a production well first.

Once production from a remote or deep part of the well falls below a predetermined level, the present invention may be used to open a less remote section of the well containing a number of drop ball operated devices using one single drop ball. Obviously, this may save considerably time otherwise required for intervention.

While the invention has been disclosed with reference to a preferred embodiment, it should be understood that a number of modifications may be done without departing from the scope defined by the accompanying claims.

The invention claimed is:

1. A drop ball activated apparatus comprising and being activated by relative movement between an outer sleeve having a first internal cylindrical surface and an inner sleeve engaged with or connected to a ball seat adapted for a drop ball and concentrically and axially slidably disposed within the outer sleeve, wherein the ball seat comprises a plurality of fingers attached to a ring at one end, where each finger extends axially to its other or distal end engaging a radially extending lug, which in a first position abuts the first internal cylindrical surface, the fingers thereby defining a first ball seat diameter less than the diameter of the drop ball, wherein the outer sleeve comprises at least one groove in its internal surface, and the lugs are adapted to move into said at least one groove in a second position, the fingers thereby defining a second ball seat diameter at least as large as the diameter of the drop ball, wherein the ball seat is retained in the outer sleeve by a first release mechanism adapted to release the ball seat and the inner sleeve from the outer sleeve when a first predetermined hydraulic pressure or force acts on the drop ball, the ball seat is engaged with or connected to the inner sleeve by a second release mechanism adapted to pull the inner sleeve while the first predetermined hydraulic pressure is exerted or applied and to release the ball seat from the inner sleeve when a second hydraulic pressure acts on the drop ball, and the ball seat further moves to the second position after being released by the second release mechanism, the ball seat being radially expandable to its second ball seat diameter.

2. Apparatus according to claim 1, wherein the finger is flexible and provides a radial outward bias on the lug.

3. Apparatus according to claim 1, wherein the groove is an annular recess having an inner diameter being larger than the inner diameter of the internal cylindrical surface.

4. Apparatus according to claim 1, wherein the second release mechanism is selected from the group consisting of: a shear pin, a stopper adapted to slide axially along a finger and to prevent radial movement of the finger until the stopper reaches the ring, and a breakable retaining band arranged around the distal ends of the fingers.

5. Apparatus according to claim 1, wherein the first release mechanism comprises at least one shear pin.

6. Method for activating an arbitrary number of drop ball operated apparatuses in a well, comprising the steps of:

providing an arbitrary number of drop ball activated apparatuses in the well, inserting a drop ball into the well, monitoring and controlling the pressure, and determining for each apparatus when the drop ball has activated and been released therefrom, the drop ball activated apparatuses comprising and being activated by relative movement between an outer sleeve having a first internal cylindrical surface and an inner sleeve engaged with or connected to a ball seat adapted for a drop ball and concentrically and axially slidably disposed within the outer sleeve, wherein the ball seat comprises a plurality of fingers attached to a ring at one end, where each finger extends axially to its other or distal end engaging a radially extending lug, which in a first position abuts the first internal cylindrical surface, the fingers thereby defining a first ball seat diameter less than the diameter of the drop ball wherein the outer sleeve comprises at least one groove in its internal surface, and the lugs are adapted to move into said at least one groove in a second position, the fingers thereby defining a second ball seat diameter at least as large as the diameter of the drop ball, wherein the ball seat is retained in the outer sleeve by a first release mechanism adapted to release the ball seat and the inner sleeve from the outer sleeve when a first predetermined hydraulic pressure or force acts on the drop ball, the ball seat is engaged with or connected to the inner sleeve by a second release mechanism adapted to pull the inner sleeve while the first predetermined hydraulic pressure is exerted or applied and to release the ball seat from the inner sleeve when a second hydraulic pressure acts on the drop ball, and the ball seat further moves to the second position after being released by the second release mechanism, the ball seat being radially expandable to its second ball seat diameter.

7. Method according to claim 6, wherein the step of monitoring and controlling the pressure further includes:

determining the point in time when the drop ball arrives at a ball seat in an upstream direction, monitoring and controlling the pressure to activate and operate the apparatus, determining the point in time when the drop ball departs from the ball seat in a downstream direction, and determining the point in time when the arbitrary number of apparatuses have been activated by the drop ball.

8. Method according to claim 6, further comprising a step of dividing the arbitrary number of drop ball activated apparatuses into a plurality of groups, each group thereof being operable by only one drop ball, wherein the diameter of the drop ball is unique for each group.

9. Method according to claim 8, further comprising a step of providing each group of drop ball activated apparatuses in a separate zone of the well.

10. Method according to claim 9, further comprising a step of ordering the zones by size of the drop balls, such that a group of drop ball activated apparatuses operated by a smaller sized drop ball is more remote from the surface than a group of drop ball activated apparatuses operated by a larger sized drop ball.

* * * * *